US007040680B2

(12) United States Patent
Grinsted

(10) Patent No.: US 7,040,680 B2
(45) Date of Patent: May 9, 2006

(54) LOAD HANDLING DEVICE

(75) Inventor: Timothy William Grinsted, Stocksfield (GB)

(73) Assignee: The Engineering Business Limited, Riding Mill (GB)

( * ) Notice: Subject to any disclaimer, the term of this patent is extended or adjusted under 35 U.S.C. 154(b) by 187 days.

(21) Appl. No.: 10/201,573

(22) Filed: Jul. 24, 2002

(65) Prior Publication Data

US 2003/0026676 A1 Feb. 6, 2003

(30) Foreign Application Priority Data

Jul. 24, 2001 (GB) ..... 0118002.5

(51) Int. Cl.
*B66C 1/00* (2006.01)

(52) U.S. Cl. ..... 294/67.5; 114/51; 212/308; 414/137.8; 414/142.8

(58) Field of Classification Search ..... 414/137.1, 414/137.8, 142.8, 139.5; 294/67.5; 212/301, 212/308, 272, 273; 114/50–51, 251
See application file for complete search history.

(56) References Cited

U.S. PATENT DOCUMENTS 3,401,804 A * 9/1968 Link ..... 414/137.7
3,955,522 A * 5/1976 Gaudiano et al. ..... 114/259
4,658,750 A 4/1987 Malcosky
4,662,300 A * 5/1987 McCallum et al. ..... 114/51
4,869,149 A 9/1989 Cavannagh et al.
5,042,415 A * 8/1991 Hoffman ..... 212/308

FOREIGN PATENT DOCUMENTS

| | | |
|---|---|---|
| DE | 19804219 | 8/1999 |
| GB | 1522131 | 8/1978 |
| GB | 2003 815 A1 | 3/1979 |
| GB | 2217671 A | 11/1989 |
| WO | WO 83/03815 A1 | 11/1983 |

* cited by examiner

*Primary Examiner*—Gene O. Crawford
*Assistant Examiner*—Mark A. Deuble
(74) *Attorney, Agent, or Firm*—Rothwell, Figg, Ernst & Manbeck

(57) ABSTRACT

In a load handling device for use with a load having a lifting attachment, the lifting attachment being so attached to the load that, when the load is suspended by the lifting attachment, the load is free to pivot relative to the lifting attachment about at least one axis. The load handling device engages the lifting attachment raises the load; so that it is suspended by the lifting attachment, and lowers it. The load handling device includes a stabiliser movable between a retracted position in which it is substantially clear of the load and an extended position in which it contacts the load on either side of the said axis to limit or control pivoting movement of the load about that axis. The stabiliser may be moveable by a plurality of hydraulic rams connected in a closed loop system. Restriction of the flow of the hydraulic fluid between the rams acts to damp movement of the load.

12 Claims, 4 Drawing Sheets

LOAD HANDLING DEVICE

BACKGROUND TO THE INVENTION

The present invention concerns the handling of loads that are designed to be lifted by means of pivoting lifting attachments, by which is meant lifting attachments so attached to the load that, when the load is suspended by the lifting attachment, the load is free to pivot relative to it about at least one axis. One example of such a load is a maritime submersible that must be lifted into and out of the sea by a shipboard load-handling device. A lifting attachment in the form of a mechanical termination is pivotally attached to the top of the submersible so that it can lie flat when not in use. When it is desired to lift the submersible by a cable attached to the mechanical termination, the cable raises the mechanical termination to an upright position. A snubber of a shipboard load-handling device is then lowered onto the submersible, the cable being retracted through it as it is lowered, until the snubber engages the mechanical termination.

Because the mechanical termination is pivotally attached to the submersible, the load is able to pivot relative to the snubber about the axis connecting the submersible and the mechanical termination. Whilst this is convenient when the submersible is afloat, it is less convenient when the submersible has been hoisted clear of the water, because the load may swing uncontrollably.

SUMMARY OF THE INVENTION

The objective of the present invention is to deal with this problem. It is achieved by providing a stabiliser movable from a retracted position to an extended position in which it contacts the load on either side of the axis about which it pivots, to restrain, resist or control pivoting movement of the load about that axis.

Therefore, the present invention provides a load handling device for use with a load having a lifting attachment, the lifting attachment being so attached to the load that, when the load is suspended by means of the lifting attachment, the load is free to pivot relative to the lifting attachment about at least one axis, the load handling device comprising means for engaging the lifting attachment, raising means for raising the load, so that it is suspended by the lifting attachment, and for lowering it, and a stabilizer movable between a retracted position in which it is substantially clear of the load and an extended position in which it contacts the load on either side of the said axis to limit or control pivoting movement of the load about that axis.

In a preferred embodiment, the line of movement of the stabiliser between the retracted position and the extended position is parallel to the line of action of the raising means for raising the load.

Preferably the stabiliser is operatively moveable between the retracted and extended positions by means of a plurality of hydraulic rams.

The stabiliser preferably comprises a unitary, substantially rigid body to which all of said plurality of hydraulic rams are attached. The stabiliser is most preferably substantially annular.

In a particularly preferred embodiment said hydraulic rams are interconnected in a closed system such that hydraulic fluid may operatively move between said rams.

In this way, the stabiliser can, when desired, move in substantial conformity with the movement of the load (for example when the load is a submersible, to accommodate movement of the submersible while still in the water).

The hydraulic system of the hydraulic rams ideally includes one or more restriction devices for restricting the flow of hydraulic fluid between said rams. In this way, the stabiliser acts to damp movement of the load when in contact therewith.

Where the restriction device is a variable restriction device the degree of restriction of the flow of the hydraulic fluid, and hence the damping action, is variable. The damping action may, for example, be progressively increased to progressively limit the movement of the load.

Means operable to prevent flow of hydraulic fluid between said rams are desirably provided so that relative movement of the hydraulic rams can be prevent and so that the load is held immobile with respect to the stabiliser.

Preferably the said hydraulic rams are arranged substantially equidistantly about the line of action of the raising means for raising the load.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
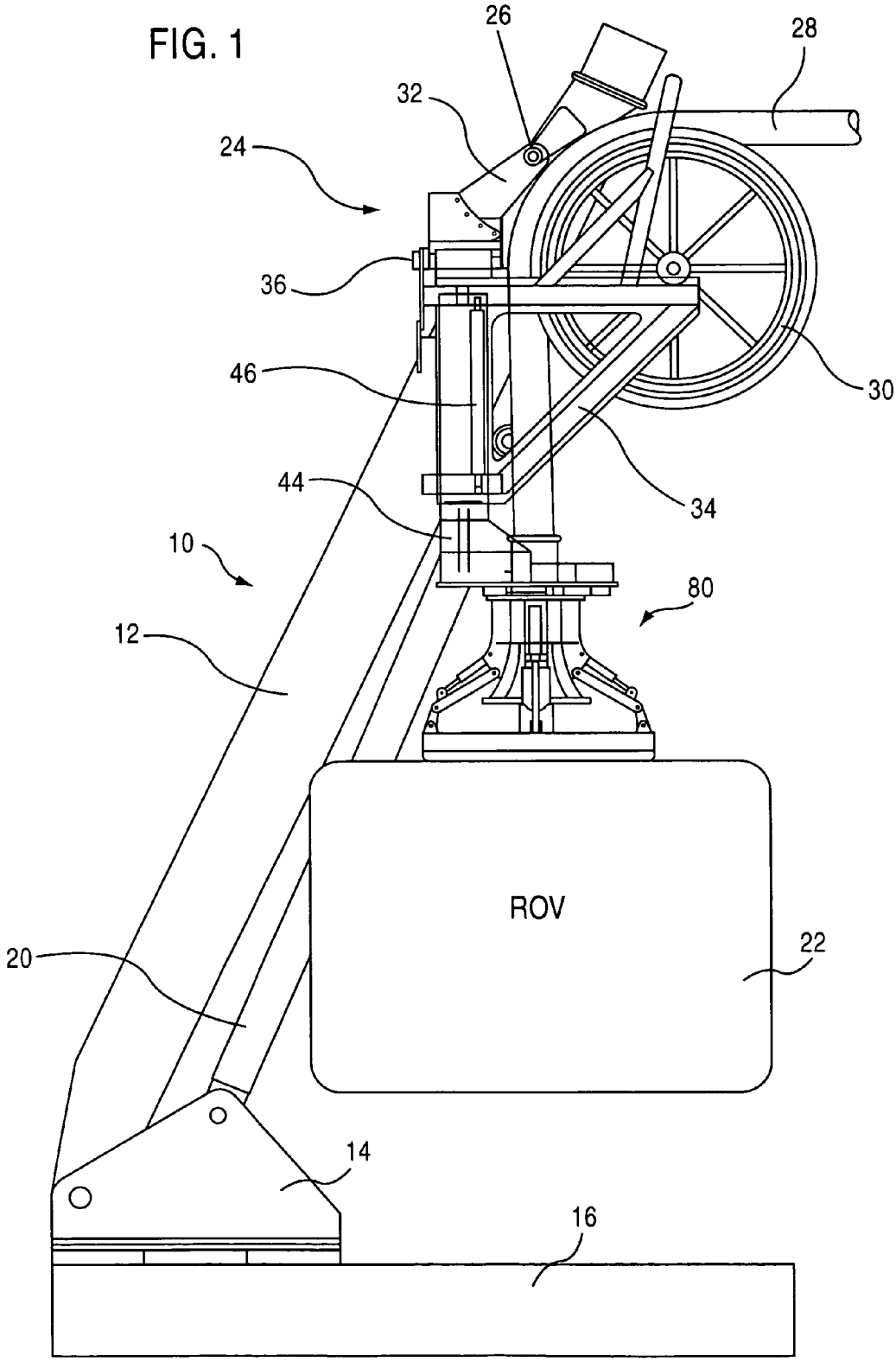
FIG. 1 is a diagram of a shipboard load-handling device.

As shown in FIG. 1, a shipboard load handling device consists of an A-frame 10, of which one leg 12 is shown, pivotally attached to mountings 14 which are bolted down to the deck 16. Movement of the A-frame 10 relative to the deck mountings 14 is achieved by a pair of hydraulic rams 20. As the rams 20 are extended, the A-frame 10 firstly moves towards the vertical, lifting the submersible 22 illustrated in FIG. 1. Then the A-frame 10 continues to rotate anticlockwise, lowering the submersible 22 overboard. A snubber 24 is pivotally attached to the upper crosspiece (not shown) of the A-frame 10 about a horizontal axis 26. A cable 28 passes from a shipboard cable store (not shown), over a pulley 30 that is attached to the snubber 24, and down through the lower part 80 of the snubber 24.

The snubber 24 consists of an upper frame 32 that provides the pivotal attachment to the A-frame 10. Pivotally attached to the upper frame 32 is a middle frame 34. The pivot axis 36 joining the upper and middle frames 32, 34 is horizontal and perpendicular to the pivot axis 26 joining the upper frame 32 of the snubber 24 and the A-frame 10. A lower frame 44 telescopes vertically from the bottom of the middle frame 34, the telescoping movement being controlled by a pair of hydraulic rams 46.

Figure 2:
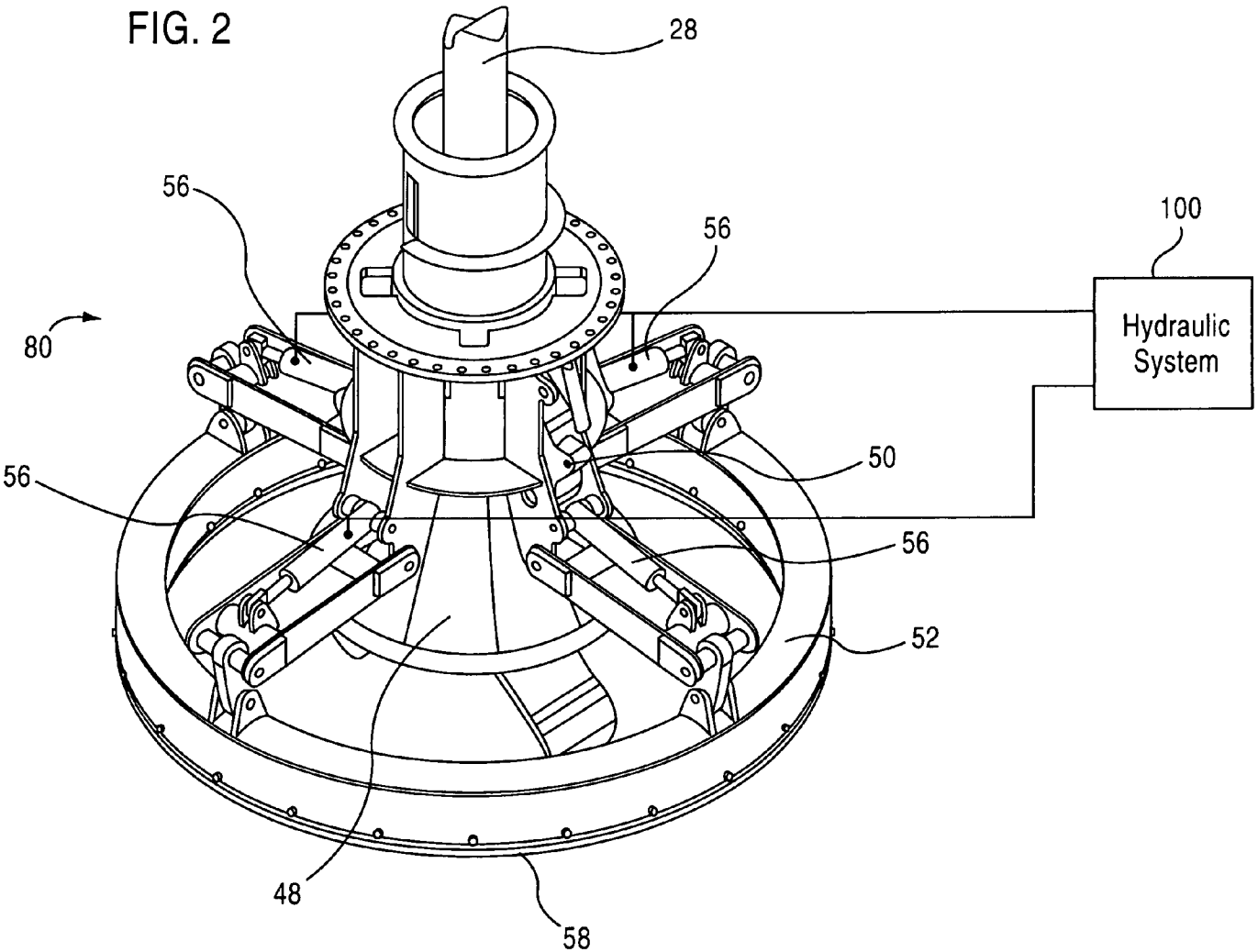
FIG. 2 is a diagram of the snubber illustrated in FIG. 1.

FIG. 2 shows the bottom (lower part 80) of the lower-frame 44 of the snubber 24 in more detail. There is a cable guide bellmouth 48 through which the cable 28 passes. Also provided are latches 50 (one of which is shown). Attached to the lower frame 44 and controlled by four hydraulic rams 56 is a stabilising ring 52. The lower face of the stabilising ring 52 is beaded with rubber 58 to reduce scuffing of the ring 52 on the top of the submersible 22. The hydraulic rams 56 may be interconnected in a closed hydraulic system 100, and move the ring 52 from a retracted or raised position to an extended or lowered position.

Figure 3:
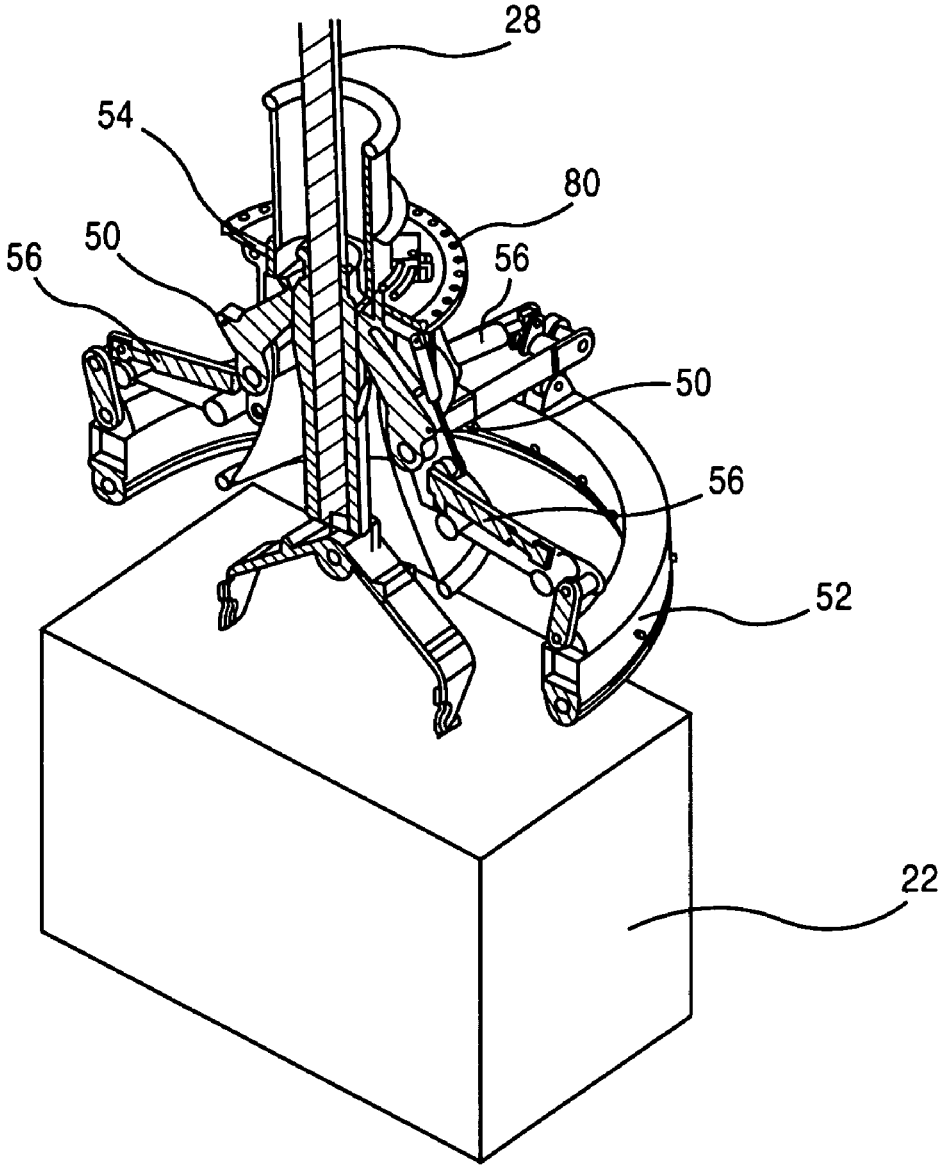
FIG. 3 is cross-section through the lower frame of the snubber and the mechanical termination of the submersible.

One method of operation of the snubber will now be described with reference to FIG. 3 which shows the submersible 22 latched to the lower part of the snubber 80. The cable 28, which passes through the cable guide bellmouth 48, is attached to the mechanical termination 54 of the submersible 22. When it is desired to hoist the submersible 22 from the sea, firstly the cable 28 is tensioned. The A-frame 10 is or has been positioned so that the lower part 80 of the snubber 24 lies substantially vertically above the submersible 22. The mechanical termination 54 of the submersible 22 is drawn into the bellmouth 48, where it is engaged by a pair of hydraulically controlled latching members 50, to enable the weight of the submersible 22 to be carried by the lower part 80 of the snubber 24. Prior to engagement of the mechanical termination 54 with the latches 50, the stabilising ring 52 is held in a retracted position by the hydraulic cylinders 56.

Figure 4C:
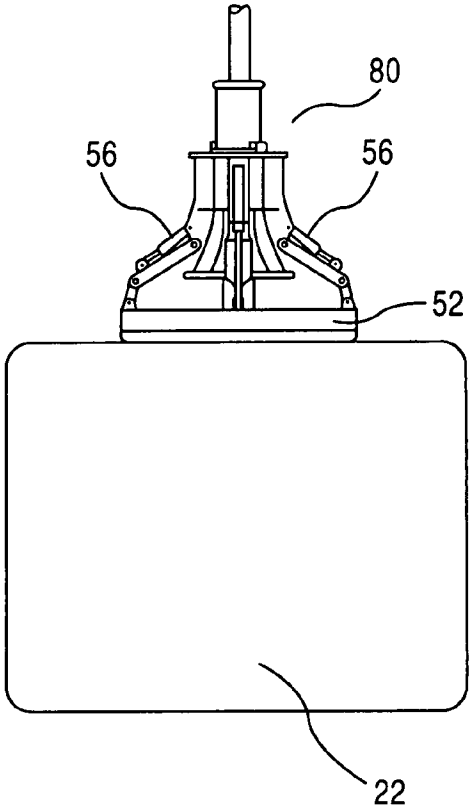
FIG. 4*c* shows the load suspended upright on the snubber with the stabiliser extended.
Figure 4B:
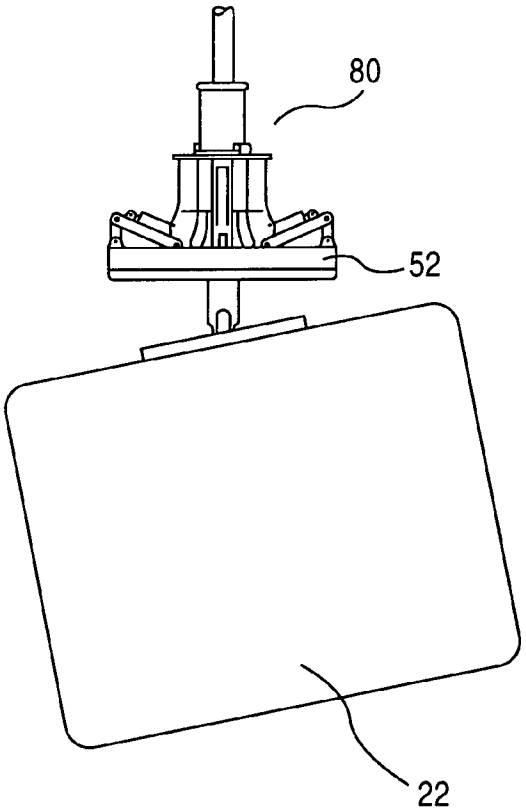
FIG. 4*b* shows the load swinging whilst suspended on the snubber with the stabiliser retracted.
Figure 4A:
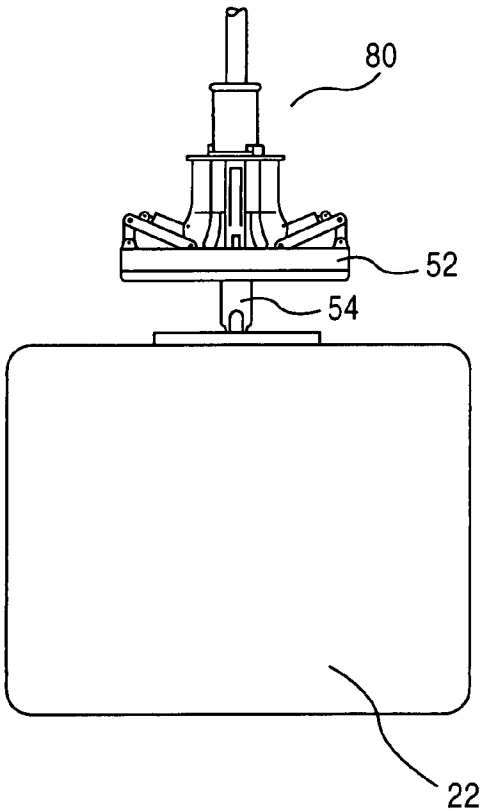
FIG. 4*a* shows the load suspended upright on the snubber with the stabiliser retracted.

FIGS. 4*a* and 4*b* illustrate the lower part 80 of the snubber 24 with a submersible 22 suspended from it with the latches 50 engaged whilst the stabilising ring 52 is retracted. As can be seen, the submersible 22 is free to pivot relative to the mechanical termination 54 and therefore relative to the lower part 80 of the snubber 24. As shown in FIG. 4*c*, as the stabilising ring 52 is lowered by means of the hydraulic rams 56, it resists and controls movement of the submersible 22 relative to the lower part 80 of the snubber 24 until it reaches a fully extended position, in which it substantially prevents such movement.

The four hydraulic rams 56 that control the stabilising ring 52 may be independently operable, but it is better that they be operable as a single closed loop unit. In this way, the ring 52 can swing with the submersible 22 to a certain extent as hydraulic fluid moves from one ram 56 to another in the loop. The rate at which fluid moves between rams 56 can be limited to provide a controlling or damping effect until the submersible 22 comes to rest. At that time, further circulation of hydraulic fluid can be cut off, to ensure that the load remains stable.

The invention claimed is:

1. A load handling device for use with a load having a lifting attachment, the lifting attachment being so attached to the load that, when the load is suspended by means of the lifting attachment, the load is free to pivot relative to the lifting attachment about at least one axis, the load handling device comprising:

means for engaging the lifting attachment;

raising means for raising the load, so that it is suspended by the lifting attachment, and for lowering it;

a stabiliser movable between a retracted position in which it is substantially clear of the load and an extended position in which it contacts the load on either side of the said axis to limit or control pivoting movement of the load about that axis; and a plurality of hydraulic rams operable to move the stabiliser between the retracted and extended positions wherein said hydraulic rams are interconnected in a closed system such that hydraulic fluid may operatively move between said rams.

2. A load handling device as claimed in claim 1 wherein the line of movement of the stabiliser between the retracted position and the extended position is parallel to the line of action of the raising means for raising the load.

3. A load handling device as claimed in claim 2 wherein the stabiliser comprises a unitary, substantially rigid body to which all of said plurality of hydraulic rams are attached.

4. A load handling device as claimed in claim 3 wherein the said hydraulic rams are arranged substantially equidistantly about the line of action of the raising means for raising the load.

5. A load handling device as claimed in claim 3 wherein the stabiliser is a substantially annular body.

6. A load handling device as claimed in claim 5 wherein the load comprises a submersible.

7. A load handling device as claimed in claim 2 further comprising restriction device for restricting the flow of hydraulic fluid between said rams whereby the stabiliser acts to damp movement of the load when in contact therewith.

8. A load handling device as claimed in claim 7 wherein the restriction device is a variable restriction device whereby the degree of restriction of the flow of the hydraulic fluid, and hence the damping action, is variable.

9. A load handling device as claimed in claim 2 further comprising means for preventing flow of hydraulic fluid between said rams.

10. A load handling device as claimed in claim 2 wherein the said hydraulic rams are arranged substantially equidistantly about the line of action of the raising means for raising the load.

11. A load handling device as claimed in claim 1 wherein the stabiliser is a substantially annular body.

12. A load handling device as claimed in claim 1 mounted on a ship.

* * * * *